US012781448B2

(12) United States Patent
Simon et al.

(10) Patent No.: US 12,781,448 B2
(45) Date of Patent: Nov. 3, 2026

(54) ROAD FINISHING MACHINE WITH LEVELING CASCADE CONTROL

(71) Applicant: JOSEPH VOEGELE AG, Ludwigshafen/Rhein (DE)

(72) Inventors: Stefan Simon, Neuhofen (DE); Philipp Stumpf, Heidelberg (DE); Ralf Weiser, Ladenburg (DE); Martin Buschmann, Neustadt (DE)

(73) Assignee: JOSEPH VOEGELE AG, Ludwigshafen/Rhein (DE)

( * ) Notice: Subject to any disclaimer, the term of this patent is extended or adjusted under 35 U.S.C. 154(b) by 1068 days.

(21) Appl. No.: 17/691,602

(22) Filed: Mar. 10, 2022

(65) Prior Publication Data

US 2022/0290382 A1 Sep. 15, 2022

(30) Foreign Application Priority Data

Mar. 12, 2021 (EP) ..... 21162228

(51) Int. Cl.
*E01C 19/42* (2006.01)
*E01C 19/00* (2006.01)
*E01C 19/48* (2006.01)

(52) U.S. Cl.
CPC ..... *E01C 19/42* (2013.01); *E01C 19/006* (2013.01); *E01C 19/48* (2013.01); *E01C 19/4873* (2013.01)

(58) Field of Classification Search
CPC .... E01C 19/42; E01C 19/4873; E01C 19/006; E01C 19/48
See application file for complete search history.

(56) References Cited

U.S. PATENT DOCUMENTS 4,807,131 A 2/1989 Clegg
5,393,167 A * 2/1995 Fujita ..... E01C 19/006 404/84.1

(Continued)

FOREIGN PATENT DOCUMENTS

CN 101248235 A 8/2008
CN 101368361 A 2/2009

(Continued)

OTHER PUBLICATIONS

DE-10025474 original and machine translation (Year: 2001).*

(Continued)

*Primary Examiner* — Kito R Robinson
*Assistant Examiner* — Zachary E. F. Glade
(74) *Attorney, Agent, or Firm* — BROOKS KUSHMAN P.C.

(57) ABSTRACT

A road finishing machine with a screed for producing a paving layer on a subsoil includes a leveling system for height adjustment of the screed for compensating for irregularities in the subsoil. The leveling system includes a cascade control having either a central control loop between outer and inner control loops that includes a control unit to determine, on the basis of a detected actual value of a pulling point position of a pulling point of the screed to a predetermined reference, and on the basis of a desired value of the pulling point position, a desired value of a leveling cylinder position, or a pulling point control between the outer and inner control loops to determine, on the basis of the desired value of the pulling point position of the pulling point of the screed, the desired value of the leveling cylinder position.

18 Claims, 2 Drawing Sheets

(56) References Cited

U.S. PATENT DOCUMENTS

| | | | | |
|---|---|---|---|---|
| 5,568,992 | A * | 10/1996 | Grembowicz | E01C 19/48 404/101 |
| 6,027,282 | A | 2/2000 | Horn | |
| 7,643,923 | B2 | 1/2010 | Buehlmann et al. | |
| 8,070,385 | B2 | 12/2011 | Green | |
| 8,079,776 | B2 | 12/2011 | Lossow | |
| 8,371,769 | B2 | 2/2013 | Worsley et al. | |
| 8,696,237 | B2 | 4/2014 | Hanfland et al. | |
| 9,033,611 | B2 | 5/2015 | Hanfland et al. | |
| 9,458,581 | B1 * | 10/2016 | Schaeding | E02F 9/2041 |
| 9,534,349 | B2 | 1/2017 | Horn et al. | |
| 11,560,675 | B2 | 1/2023 | Buschmann et al. | |
| 2009/0047069 | A1 * | 2/2009 | Herrmann | E01C 19/008 404/75 |
| 2011/0126533 | A1 * | 6/2011 | Noll | B60W 30/1882 60/431 |
| 2011/0255918 | A1 | 10/2011 | Worsley et al. | |
| 2012/0321386 | A1 | 12/2012 | Hanfland et al. | |
| 2013/0253780 | A1 * | 9/2013 | Smieja | E01C 19/48 701/50 |
| 2017/0044726 | A1 | 2/2017 | Buschmann et al. | |
| 2018/0340302 | A1 | 11/2018 | Menzenbach et al. | |
| 2019/0177930 | A1 | 6/2019 | Ramb et al. | |
| 2021/0010210 | A1 * | 1/2021 | Ellwein | E01C 19/48 |
| 2022/0112669 | A1 | 4/2022 | Weiser et al. | |

FOREIGN PATENT DOCUMENTS

| | | | | |
|---|---|---|---|---|
| CN | 102174792 | A | 9/2011 | |
| CN | 102220738 | A | 10/2011 | |
| CN | 102839592 | A | 12/2012 | |
| CN | 106522065 | A | 3/2017 | |
| CN | 107741719 | A | 2/2018 | |
| CN | 109914203 | A | 6/2019 | |
| CN | 111601929 | A | 8/2020 | |
| CN | 111945524 | A | 11/2020 | |
| DE | 29619831 | U1 | 1/1997 | |
| DE | 196 47 150 | A1 | 5/1998 | |
| DE | 10025462 | A1 | 12/2001 | |
| DE | 10025474 | A1 * | 12/2001 | G01B 21/18 |
| DE | 10 2005 022266 | A1 | 11/2006 | |
| DE | 112009001767 | T5 | 9/2011 | |
| DE | 10 2011 001542 | A1 | 12/2012 | |
| DE | 102015001101 | A1 | 8/2016 | |
| EP | 1672122 | A1 | 6/2006 | |
| EP | 2535456 | A1 | 12/2012 | |
| EP | 3178992 | A1 | 6/2017 | |
| JP | H04179710 | A | 6/1992 | |

OTHER PUBLICATIONS

European Search Report Dated Apr. 8, 2021 (with English Machine Translation), Application No. 20200791.0-1002, Applicant Joseph Voegele AG, 20 Pages.

U.S. Appl. No. 17/497,086, filed Oct. 8, 2021, 18 Pages.

USPTO Office Action in U.S. Appl. No. 17/497,086 dated Dec. 19, 2024 (34 pages).

European Search Report Dated Sep. 7, 2021, (with English Machine Translation), Application No. 21162228.7-1002—Applicant Joseph Voegele AG, 10 Pages.

First Office Action and Search Report for Chinese Patent Application No. 202111158048.1, dated Jan. 19, 2023, 5 Pages.

Pu Xinzheng, Exploring the Application of Ultrasonic Sensors in the Automatic Leveling Control system of Paver, China New News 07th period, Apr. 5, 2017, 85, School of Mechanical and Electrical Engineering, Jiangsu Vocational and Technical College of Architecture.

CNIPA First Office Action in CN Application No. 202210249699X dated Mar. 15, 2024 (5 pages, including English translation).

Chinese Search Report for CN Application No. 202210249699X, dated Mar. 13, 2024, 10 pages.

JPO Office Action in JP Application No. 2021-165520 dated Mar. 7, 2025 (4 pages, including English translation).

Indian Patent Application No. 2020/14019027A, filed Nov. 20, 2020, 19 Pages.

* cited by examiner

ROAD FINISHING MACHINE WITH LEVELING CASCADE CONTROL

CROSS-REFERENCE TO RELATED APPLICATIONS

This application claims foreign priority benefits under 35 U.S.C. § 119(a)-(d) to European patent application number EP 21162228.7, filed Mar. 12, 2021, which is incorporated by reference in its entirety.

TECHNICAL FIELD

The present disclosure relates to a road finishing machine with a leveling system. Furthermore, the present disclosure relates to a method for levelling a screed of a road finishing machine.

BACKGROUND

Known road finishing machines are fitted with leveling systems which serve, during a pavement drive, to compensate irregularities of the subsoil that act on the running gear of the road finishing machine or directly on the screed of the road finishing machine. Based on the sensor measurements of a leveling system, the screed of the road finishing machine can be height-adjusted by means of a leveling cylinder that includes an extendable piston coupled to the screed to produce a plane paving layer.

In conventional leveling systems, the distance sensor is, if leveling is accomplished by means of a guiding wire and a distance sensor, installed at the tow bar between a front pulling point embodied thereat to which the piston of the leveling cylinder is attached, and the screed body dragged by means of the tow bar, i.e., in the direction of travel, approximately at the level of the transverse distributor means. From this position, the distance sensor detects neither the exact position of the screed's trailing edge located behind it which generally defines a screed height and decisively determines the evenness of the installed pavement, nor the influence of ground irregularities on the front pulling point. These inaccurate sensor measurements do not depict the present subsoil with its exact profile, so that no leveling of the screed results based thereon whereby irregularities of the subsoil can be precisely compensated.

DE 196 47 150 A1 discloses a road finishing machine with a leveling system including a height control loop as a pilot controller operating on the basis of a measured altitude of the trailing edge of the screed. It is configured to generate a control signal as a reference signal for a pulling point control loop embodied as a sequence control, which controls, based thereon and in view of a detected inclination of the pulling arm of the screed, a hydraulic valve of a leveling cylinder coupled with the front pulling point of the screed.

DE 100 25 474 B4 discloses a leveling system which employs a layer thickness control loop as a pilot control unit from which a control signal results on the basis of a calculated actual layer thickness value and on the basis of a desired layer thickness value. This control signal specifies a desired inclination value that can be held available for an evenness control loop embodied as a sequence control. This evenness control loop calculates, on the basis of the actual inclination value held available for it, and on the basis of an inclination of the pulling arm detected during the pavement drive, a manipulated variable for controlling a leveling cylinder for the height adjustment of the screed.

In DE 196 47 150 A1 and DE 100 25 474 B4, the disturbing influence of the subsoil on a pulling point position cannot be perfectly eliminated by means of the two-stage controller means. This is aggravated by the use of inclination sensors which are particularly susceptible to disturbances by irregularities in the subsoil.

SUMMARY

It is the object of the disclosure to provide a road finishing machine with a leveling system by means of which a disturbing influence of the subsoil on the pulling point position of the screed can be almost completely compensated. It is furthermore the object of the disclosure to provide a leveling method for a road finishing machine which precisely responds to the present subsoil profile.

The disclosure relates to a road finishing machine with a screed for producing a paving layer on a subsoil on which the road finishing machine is moving during a pavement drive in the direction of travel. The road finishing machine according to the disclosure comprises, for compensating for irregularities of the subsoil, a leveling system for the height adjustment of the screed, the leveling system including a cascade control.

The cascade control comprises an outer control loop including a first control unit (hereinafter also referred to as screed control unit) which is embodied to determine, on the basis of a detected actual value of a screed height of the screed relative to a predetermined reference, and on the basis of a desired value of the screed height relative to the predetermined reference that can be held available for it, a desired value of a pulling point position of a pulling point of the screed relative to the predetermined reference. Screed height here in particular means the height of a screed's trailing edge of the screed. The pulling point position is preferably determined by a front end of the pulling arm of the screed.

The cascade control furthermore comprises an inner control loop including a second control unit (hereinafter also referred to as leveling cylinder control unit) which is embodied to determine, on the basis of a detected actual value of a leveling cylinder position of an extendable piston of a leveling cylinder attached to the pulling point, and on the basis of a desired value of the leveling cylinder position held available for the second control unit, a control signal for the leveling cylinder by means of which the leveling cylinder can be controlled.

According to the disclosure, the cascade control either comprises, between the outer and the inner control loops, a central control loop including a third control unit (hereinafter also referred to as pulling point control unit), which is embodied to determine, on the basis of a detected actual value of the pulling point position of the pulling point of the screed to the predetermined reference, and on the basis of the desired value of the pulling point position determined by means of the first control unit, the desired value of the leveling cylinder position for the second control unit, or the cascade control includes, between the outer and the inner control loops, a pulling point control which is embodied to determine, on the basis of the desired value of the pulling point position of the pulling point of the screed determined by means of the first control unit, and in particular on the basis of a digital terrain model of the subsoil on which the road finishing machine is moving for producing the paving layer, which model is held available for the pulling point control system, the desired value of the leveling cylinder position for the second control unit.

In the first alternative according to the disclosure, the cascade control comprises at least three control loops, that is one outer, one central, and one inner control loop which are interleaved for generating the control signal for the leveling cylinder. By means of the three-stage cascade leveling system provided thereby, in particular using the central control loop directly responding to subsoil irregularities, an unknown pulling point disturbance acting from the subsoil profile via the running gear of the road finishing machine on the pulling point can be perfectly compensated.

The second alternative of the road finishing machine according to the disclosure provides a cascade control with an integrated pulling point control for an improved leveling of the screed. The pulling point control employed for this forms a pilot control for the inner control loop, and a sequence control for the outer control loop and can nearly completely compensate the pulling point disturbance on the basis of the digital terrain model held available for it in which subsoil irregularities are taken into consideration as known.

By means of both alternatives, a better compensation of irregularities of the subsoil is possible because both the influence of irregularities on the screed height and the influence of irregularities on the pulling point mechanism are directly detected and taken into consideration for generating the control signal for setting the leveling cylinder.

Both above-mentioned alternatives of the road finishing machine according to the disclosure permit disturbing influences on the pulling point position and the screed caused by irregularities formed in the subsoil to be precisely detected and correspondingly nearly completely corrected. The reason for this mainly is that the leveling system is subdivided into a plurality of closed-loop and open-loop controlled system sections which can be better designed in view of their respective closed-loop/open-loop controlled system to nearly completely compensate present irregularities of the subsoil and other disturbance variables occurring in practice in the leveling of the screed.

In particular the subdivision of the coherent closed-loop controlled system of the outer control loop into the above-mentioned alternatives has a positive effect on the compensation of the irregularities of the subsoil, that means the combination of the superimposed inner and central closed loops or the combination of the inner closed loop with the preceding pulling point control. These alternative combinations each permit that the combined closed-loop control system of the outer control loop can be better controlled for an effective disturbance variable compensation due to their subdivision into partial sections.

Preferably, the outer control loop comprises a controlled system whose output quantity (controlled variable) is the detected actual value of the screed height of the screed relative to the predetermined reference, and/or whose input quantity is the detected actual value of the pulling point position of the pulling point of the screed relative to the predetermined reference. As an alternative, the input quantity can be an actual value of the pulling point position of the pulling point calculated in response to a detected actual value of the leveling cylinder position. The outer control loop permits to adjust the screed height in view of the predetermined reference, for example, a guiding wire tensioned next to the roadway.

In one variant, the leveling system includes at least one first sensor for the outer control loop which is embodied to detect the actual value of the screed height. Therefore, this sensor will also be referred to as screed sensor below. In particular, the first sensor is embodied to detect a distance of the screed's trailing edge of the screed to the predetermined reference. According to one embodiment of the disclosure, the first sensor is a distance sensor for detecting a distance to the predetermined reference which is positioned in the region of a screed's trailing edge of the screed. For example, the sensor is attached to a lateral pusher of the screed. Thereby, the actual height position of the screed can be precisely detected as a controlled variable, above all a height position of the trailing edge embodied thereat, and be supplied to the first control unit of the outer control loop by feedback. The outer feedback can build upon the feedback of the inner control loop, wherein the inner feedback preferably runs faster so that the disturbance variable compensation and the pilot behavior of the outer control loop can be better matched by means of the inner closed loop or closed loops.

Preferably, the inner control loop comprises a closed-loop control system whose output quantity is the detected actual value of the leveling cylinder position of the extendable piston of the leveling cylinder attached to the pulling point, and/or whose input quantity is the control signal for the leveling cylinder.

In one advantageous variant, the leveling system for the inner control loop includes at least one second sensor which is embodied to detect the actual value of the leveling cylinder position. This sensor will also be referred to as leveling cylinder sensor below. It is advantageous for the second sensor to be a distance sensor for detecting an extension path of the piston of the leveling cylinder positioned in the region of the leveling cylinder. Thereby, the leveling cylinder position can be precisely detected as a controlled variable, in particular the current extension path of the leveling cylinder piston, and be supplied to the second control unit of the inner control loop by feedback.

It is convenient for the central control loop to include a closed-loop controlled system whose output quantity is the detected actual value of the pulling point position of the screed, and/or whose input quantity is the detected actual value of the leveling cylinder position.

According to one embodiment of the disclosure, the leveling system for the central control loop includes at least one third sensor (hereinafter also referred to as pulling point sensor) which is embodied to detect the actual value of the pulling point position to the predetermined reference. It is convenient for the third sensor to be a distance sensor for detecting a distance to the predetermined reference which is positioned in the region of the pulling point of the screed. Thereby, the pulling point position directly influenced by irregularities can be precisely detected as a controlled variable and be supplied to the third control unit of the central control loop by feedback.

In particular, the sensors for detecting the screed and pulling point positions can be embodied as position measurement sensors. The use of laser, ultrasonic, LIDAR and/or radar sensors would be conceivable. As a measuring means for detecting the screed and pulling point positions, according to a preferred variant, at least one tachymeter arranged at the road finishing machine and/or a laser receiver attached to the screed unit can be employed. It is conceivable that the tachymeter is embodied to be automatically adjustable by a motor for the target tracking of the predetermined reference.

It would be conceivable that instead of two distance sensors installed at the screed's trailing edge and the pulling point, a longitudinal gradient sensor in combination with a distance sensor is employed. Then, the distance sensor can be installed at the screed arm at any point between the screed's trailing edge and the pulling point. The inclination sensor measures the set angle of the screed. Here, due to the known screed geometry, it is irrelevant at which position of the screed or the tow bar the inclination sensor is installed. If the sensor combination described herein is employed, the distances of the screed's trailing edge and the pulling point to the reference (see the distances $y_{bo}$ and $y_{zp}$ represented in FIG. 2) can be determined by trigonometric calculations based on the measured angle and the measured distance. The construction and parameterization of the control units remain unaffected thereby. This sensor configuration can also be employed if a subsoil model is employed as a reference (hereinafter also referred to as virtual reference).

Preferably, the cascade control includes at least one disturbance variable feedforwarding. It would be possible for the disturbance variable feedforwarding to function on the basis of a calculated indirect determination of at least one disturbance variable, and/or on the basis of at least one directly measurable disturbance variable. By means of the disturbance variable feedforwarding, a manipulated variable, for example the manipulated variable for the pulling point position, can be proactively adapted by an upstream transmission function instead of allowing the effect of the disturbance variable on the controlled variable present at the output.

It is conceivable that the disturbance variable feedforwarding is fitted with at least one filter for smoothing calculated or detected disturbance variables. Thereby, the reaction of the control unit functionally connected to the disturbance variable feedforwarding can be attenuated. For the disturbance variable feedforwarding, measurements of a subsoil profile recorded by means of a scanner can be employed, and/or a digital terrain model can be employed.

The cascade control in particular comprises a first disturbance variable feedforwarding for the outer control loop, and a second disturbance variable feedforwarding for the central control loop. Thereby, irregularities of the subsoil and/or other disturbance variables occurring during the paving operation, for example disturbance variables concerning mechanical and/or hydraulic systems of the road finishing machine, can be proactively and by quick response compensated without them perceivably influencing the cascaded feedback of the controlled variables.

The respective disturbance variable feedforwarding can be activated and deactivated independently individually or together. It is conceivable that, based on at least one process parameter measured at the road finishing machine during the paving operation, and/or on the basis of a measured property of the produced paving layer, at least one disturbance variable feedforwarding directly or indirectly responding to the process parameter and/or the property of the paving layer is activatable automatically.

Preferably, the cascade control is supplemented by a layer thickness calculation module which is embodied to determine, on the basis of an identified current layer thickness of the produced paving layer, and/or on the basis of a desired value of the layer thickness of the paving layer to be produced which is held available for it, the desired value of the screed height as a reference input for the outer control loop. By means of this cascade control, the compensation of subsoil irregularities can be completed by the production of a desired layer thickness.

In one variant, the layer thickness calculation module is configured to determine the layer thickness from a progression of the sensor measurements employed for the leveling operation and optionally temporarily stored.

The actual value of the layer thickness can be identified by means of a layer thickness measuring system embodied at the road finishing machine. It would be conceivable to use, for the identification of the produced layer thickness, the measuring results of at least one distance sensor whose measuring results also serve for the operation of the leveling system.

The reference is designed as a real physical reference (e.g., guiding wire) according to one variant. In practice, however, a physical reference is not always available. In this case, a reference which is herein referred to as "virtual" is employed. This can be, for example, a rotational laser and a laser receiver mounted to the screed, or a tachymeter which tracks a prism mounted to the screed. In these two measuring methods, no typical distance sensors are employed since the reference and the sensor form one system.

A virtual reference according to the embodiment from a practical view is a mathematical model of the subsoil which is present as a digital terrain model (DGM) or in another digital form (data of a (laser) scanner). In the use of such a reference, distance sensors still determine the distance to the subsoil and thus to the reference. The corresponding desired distance for the screed and pulling point to the subsoil is in this case selected in response to the location such that the desired screed height is adjusted. For the desired value of the screed control unit, $r_{bo}(x)=z_{bo_{soll}}(x)-z_{ref}(x)$ with $r_{bo}(x)>0\forall x$ applies. In the pulling point control unit, the control signal of the screed control unit is analogously superimposed by the negative progression of the reference to reach the pulling point position desired by the screed control unit.

The disclosure furthermore relates to a method for leveling a screed of a road finishing machine for producing a paving layer on a subsoil on which the road finishing machine is moving during a pavement drive in the direction of travel. According to the disclosure, irregularities in the subsoil are compensated by means of a leveling system which performs a height adjustment of the screed by means of a cascade control.

In the method according to the disclosure, an outer control loop of the cascade control determines, by means of a first control unit, on the basis of a detected actual value of a screed height of the screed relative to a predetermined reference, and on the basis of a desired value of the screed height relative to the predetermined reference held available for the first control unit as a reference input, a desired value of a pulling point position of a pulling point of the screed relative to the predetermined reference.

Furthermore, an inner control loop of the cascade control determines, by means of a second control unit, on the basis of a detected actual value of a leveling cylinder position of an extendable piston of a leveling cylinder attached to the pulling point of the screed, and on the basis of a desired value of the leveling cylinder position held available for the second control unit, a control signal for the leveling cylinder by means of which the leveling cylinder is controlled for the height adjustment of the screed.

The method according to the disclosure provides either that a central control loop of the cascade control integrated between the outer and the inner control loop determines, by means of a third control unit, on the basis of a detected actual value of the pulling point position of the pulling point of the screed relative to the predetermined reference, and on the basis of the desired value of the pulling point position determined by means of the first control unit, the desired value of the leveling cylinder position for the second control unit, or that a pulling point control functionally incorporated between the outer and the inner control loops determines, on the basis of the desired value of the pulling point position of the pulling point of the screed determined by means of the first control unit, and in particular on the basis of a digital terrain model of the subsoil on which the road finishing machine is moving for producing the paving layer, which model is held available for the pulling point control, the desired value of the leveling cylinder position for the second control unit.

Accordingly, by means of the method according to the disclosure, the desired value of the leveling cylinder position provided as a reference input for the setting of the leveling cylinder, and thereby also the manipulated variable for the leveling cylinder required by it, is determined either by means of a three-stage interleaved cascade control, that means by the superimposed first, second and third control loops, or on the basis of the outer and inner control loops and the pulling point control embodied therebetween. By means of both alternatives, a better compensation of irregularities of the subsoil is possible because both the influence of irregularities on the screed height and the influence of irregularities on the pulling point mechanism are directly detected and taken into consideration for generating the control signal for setting the leveling cylinder.

Preferably, the cascade control is supplemented by at least one disturbance variable feedforwarding. The latter can proactively respond to irregularities of the subsoil and other disturbance variables for determining the pulling point and/or a leveling cylinder position of the desired value and reliably compensate them by supplying the disturbance variables in connection therewith to the screed control unit, i.e., the control unit of the outer control loop, and/or the pulling point control unit, i.e., the control unit of the central control loop, by means of a predetermined transmission function.

According to one embodiment, the cascade control is supplemented by a layer thickness calculation module which determines, on the basis of a layer thickness of the produced paving layer identified during the pavement drive, and/or on the basis of a desired value of the layer thickness of the paving layer to be produced which is held available for it for the outer control loop, the desired value of the screed height. The layer thickness calculation module could use, for example, the leveling sensor signals to calculate the desired screed height.

BRIEF DESCRIPTION OF THE DRAWINGS

Embodiments of the disclosure will be illustrated more in detail with reference to the following figures. In the drawing.

Technical features are always provided with the same reference numerals in the figures.

DETAILED DESCRIPTION

Figure 1:
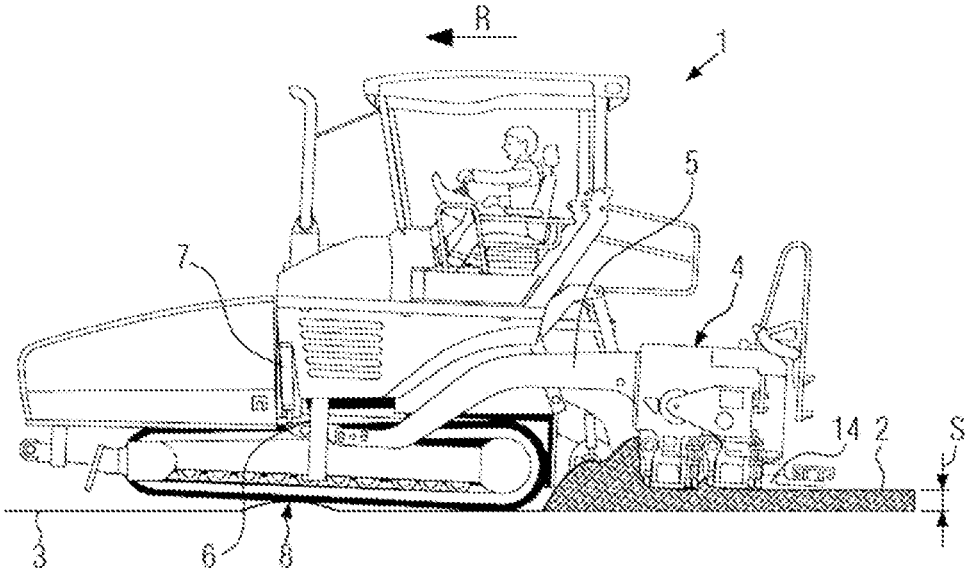
FIG. 1 shows a road finishing machine for producing a paving layer on a subsoil.

FIG. 1 shows a road finishing machine 1 that produces a paving layer 2 with a desired layer thickness S on a subsoil 3 on which the road finishing machine 1 is moving in a direction of travel R during a pavement drive. The road finishing machine 1 has a leveling screed 4 for compacting the paving layer 2. The screed 4 includes a pulling arm 5 which is connected, at a front pulling point 6, with a levelling cylinder 7 attached to the chassis of the road finishing machine 1. The leveling cylinder 7 can lift and lower the pulling arm 5 at the front pulling point 6 so that a set angle of the dragged screed 4 can be set during the paving drive, where in response thereto, the screed 4 is lifted or lowered. In particular, by a dynamic control of the leveling cylinder setting, irregularities 8 of the subsoil 3 can be compensated.

Figure 2:
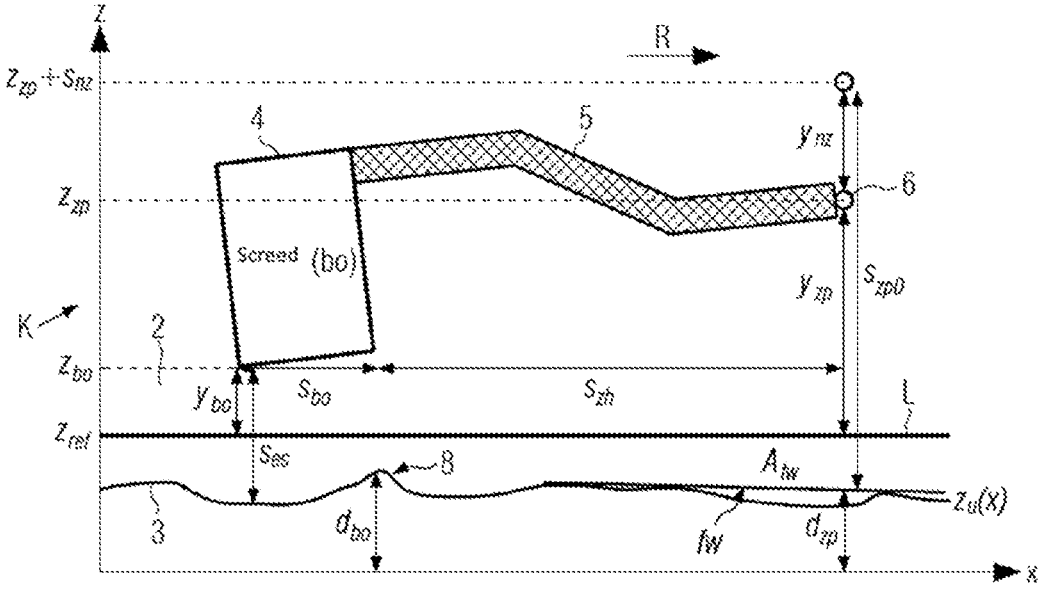
FIG. 2 shows an isolated schematic representation of a screed of the road finishing machine in a reference coordinate system.

FIG. 2 shows an isolated, schematic representation of the screed 4 in a reference coordinate system K, including dimensions concerning the subsoil 3 and the screed geometry, which will be illustrated more in detail in connection with FIGS. 3 and 4 below.

Figure 3:
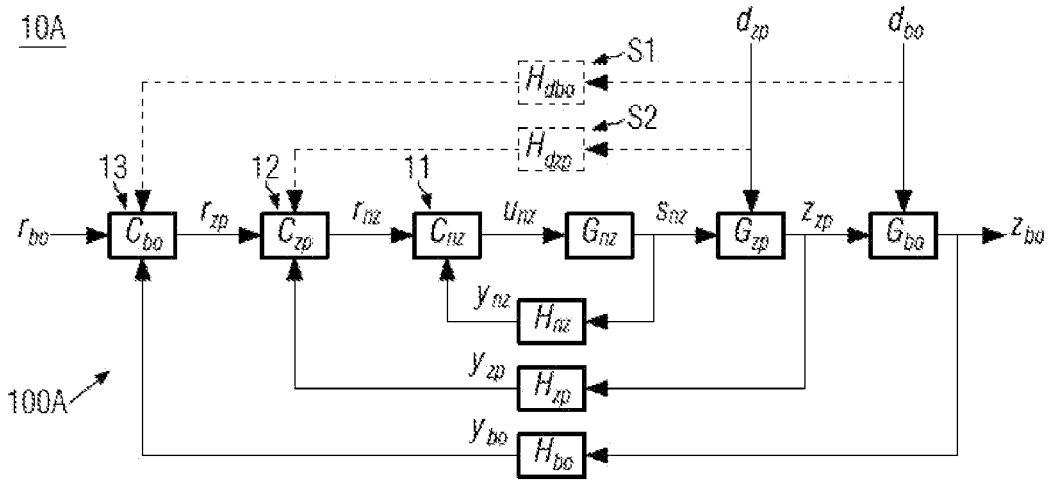
FIG. 3 shows a schematic representation of a first variant of the leveling system for the screed of the road finishing machine according to the disclosure.

FIG. 3 shows a leveling system 10A embodied to level the screed 4. The leveling system 10A comprises a cascade control 100A comprising three superimposed control loops, namely an inner control loop 11, a central control loop 12, and an outer control loop 13.

The outer control loop 13 includes a first sensor $H_{bo}$ (screed sensor), the inner control loop 11 a second sensor $H_{nz}$ (leveling cylinder sensor), and the central control loop 12 a third sensor $H_{zp}$ (pulling point sensor). Each one of the three control loops 11, 12, 13 thus includes each one separate sensor according to FIG. 2. The sensors $H_{bo}$, $H_{nz}$, $H_{zp}$ are configured to measure the distances represented in FIG. 2, in particular the extension path of the leveling cylinder $s_{nz}$, the screed height $z_{bo}$, and the pulling point position $z_{zp}$. Corresponding sensor signals $y_{bo}$, $y_{nz}$, $y_{zp}$ are supplied from the respective sensors $H_{bo}$, $H_{nz}$, $H_{zp}$ to the three control units $C_{bo}$, $C_{zp}$, $C_{nz}$ as actual controlled variables.

According to FIG. 2, the cascade control 100A is supplemented by an optional disturbance variable feedforwarding S1, S2 which is here represented schematically in a dashed form.

First of all, the cascade control 100A will be described below without the disturbance variable feedforwarding S1, S2. The three control loops 11, 12, 13 of the cascade control 100A are interleaved. In the outer control loop 13, the screed height $z_{bo}$ is adjusted. The dynamic behavior of the closed-loop controlled system "screed" is described by the transmission function $G_{bo}$. The output variable of this closed-loop controlled system is the detected screed height $z_{bo}$. The screed height $z_{bo}$ is detected by the screed sensor $H_{bo}$ which is installed near a screed's trailing edge 14 (see FIGS. 1 and 2). The corresponding sensor signal $y_{bo}$ is supplied to the control unit $C_{bo}$ by feedback. The input variable of the transmission function $G_{bo}$ is the measured actual value of the pulling point position $z_{zp}$. The corresponding desired value of the pulling point position $r_{zp}$ is the control signal of the first control unit $C_{bo}$ (screed control unit) and is calculated from the desired value of the screed height $r_{bo}$ and the sensor signal $y_{bo}$ held available here.

The control signal $r_{zp}$ of the outer control loop 13 is the reference signal of the central control loop 12 which adjusts the pulling point position $z_{zp}$ by means of the pulling point control unit $C_{zp}$. The actual value of the pulling point position $z_{zp}$ is detected by means of the sensor $H_{zp}$ which determines the distance of the pulling point from the reference L (for example, a rope or guiding wire tensioned next to the roadway). Here, the pulling point position $z_{zp}$ is the output quantity of the pulling point mechanism $G_{zp}$. The resulting sensor signal $y_{zp}$ is returned to the pulling point control unit $C_{zp}$. The control signal of the pulling point control unit $C_{zp}$ is the desired value of the leveling cylinder position $r_{zp}$.

Thus, the control signal of the pulling point control unit $C_{zp}$ represents the reference input of the inner control loop 11 whose actual value is the leveling cylinder position $s_{nz}$. The inner control loop 11 comprises, as the closed-loop controlled system, the leveling cylinder function $G_{nz}$, wherein the sensor $H_{nz}$ detects the leveling cylinder position and supplies it to the leveling cylinder control unit $C_{nz}$. Here, $u_{nz}$ is the control signal of the leveling cylinder control unit $C_{nz}$ which acts on the leveling cylinder 7.

By means of the previously described cascade control 100A, the disturbing influence of the subsoil $d_{zp}$ on the pulling point position $z_{zp}$ can be nearly completely corrected. Moreover, due to the exact detection of the screed height $z_{bo}$, it can be directly adjusted, and one can better counteract against the disturbance $d_{bo}$ which acts on $z_{bo}$.

On the basis of the three sensor signals $y_{bo}$, $y_{nz}$, $y_{zp}$ and in view of the design presented in FIG. 2, the following correlations can be derived:

$$z_{bo}=y_{bo}+z_{ref} \tag{1}$$

$$d_{zp}=y_{zp}+z_{ref}+y_{nz}-s_{zp0} \tag{2}$$

Here, $d_{zp}$ is given by the interaction of the running gear fw with the subsoil 3, here in FIG. 2 subsoil $z_u$. Thus, $d_{zp}=fw(z_u)$ applies. Consequently, the subsoil profile can be calculated by the inverse function of the running gear function. The following applies:

$$z_u=fw^{-1}(d_{zp}) \tag{3}$$

Since for the layer thickness, $s_{es}=z_{bo}-z_u$ applies, the layer thickness $s_{es}$ can be determined by means of the correlations (1)-(3) by the three sensor signals $y_{bo}$, $y_{nz}$, $y_{zp}$. The following applies:

$$s_{es}=y_{bo}+z_{ref}-fw^{-1}(y_{zp}+z_{ref}+y_{nz}-s_{zp0}) \tag{4}$$

If the influence of the running gear is neglected, i.e., $z_u \approx d_{zp}$ is assumed, the following applies:

$$s_{es}=y_{bo}-y_{zp}-y_{nz}+s_{zp0} \tag{5}$$

$$d_{bo}=d_{zp} \tag{6}$$

In the implementation of the equations (5) and (6), the location dependency is to be considered. This means, the following applies:

$$d_{bo}(x)=d_{zp}(x-s_{zh}) \text{ and}$$

$$s_{es}(x)=y_{bo}(x)-y_{zp}(x-s_{zh}-s_{bo})-y_{nz}(x-s_{zh}s_{bo})+s_{zp0}$$

Thus, the signals $y_{bo}$, $y_{nz}$, $y_{zp}$ are recorded, and the screed disturbance $d_{bo}(x)$ is calculated at the way point x from the pulling point disturbance $d_{zp}$ of the previous way point $x-s_{zh}$. The information with respect to the paving thickness $s_{es}(x)$ can be displayed to the operator, for example on a display at the external control stand of the screed.

Moreover, the above cascade control 100A can be extended by a layer thickness calculation module for the layer thickness control for which a desired layer thickness can be held available as a desired layer thickness based on which the layer thickness calculation module calculates the desired value of the screed height $r_{bo}$.

The particularity of the layer thickness calculation module is that the correlation between the layer thickness and the screed height is algebraic. This means that a change of the layer thickness exactly corresponds to the same change of the screed height. To implement a layer thickness control, two variants are conceivable.

In the first variant, the current layer thickness is identified from the progression of the sensor measurements and compared to the desired layer thickness held available. This deviation is processed in the screed control unit to a change of the screed height. In the second variant, the correlation $$s_{es}(x)=y_{bo}(x)-y_{zp}(x-s_{zh}-s_{bo})-y_{nz}(x-s_{zh}-s_{bo})+s_{zp0}$$

can be utilized to determine the desired value of the screed height $r_{bo}$ directly from the desired layer thickness. To calculate the desired screed height $r_{bo}$ from the desired layer thickness $r_{es}$, $s_{es}=r_{es}$ and $y_{bo}=r_{bo}$ are inserted in the above equation. Subsequently, a resolution is made with respect to $r_{bo}$. This leads to $$r_{bo}(x)=r_{es}(x)+y_{zp}(x-s_{zh}s_{bo})+y_{nz}(x-s_{zh}-s_{bo})-s_{zp0}.$$

Thus, the difference between the cascade control and the cascade control extended by the layer thickness calculation module essentially is whether the user indicates a desired value for the screed height or for the layer thickness.

The above described cascade control 100A can be extended by the disturbance variable feedforwarding S1, S2 represented in a dashed line in FIG. 2. Here, information with respect to the subsoil $z_u$ and the resulting disturbances $d_{bo}$ and $d_{zp}$ are detected and supplied to the screed control unit $C_{bo}$ and the pulling point control unit $C_{zp}$ which use them for calculating the desired pulling point and leveling cylinder positions $r_{zp}$, $r_{nz}$ to proactively compensate the disturbance variables $d_{bo}$ and $d_{zp}$ without waiting for them to have an influence on the controlled variables $z_{bo}$, $z_{zp}$. Here, in the control signal calculation in the screed control unit $C_{bo}$, it is taken into consideration that the disturbance $d_{bo}$ lags behind with a dead time of the disturbance $d_{zp}$ depending on the paving speed. Both the calculated determination of the disturbance variables $d_{bo}$ and $d_{zp}$ as described above and the direct measurement of the disturbance variables $d_{bo}$ and $d_{zp}$ by means of suited measurement systems $H_{dbo}$ and $H_{dzp}$ (e.g., scanner and the like) are possible. Here, measurement can be accomplished both "online", i.e., during paving, and "offline", i.e., before paving, for example by means of a digital terrain model (DGM). Progresses measured offline are here stored in the controlling system.

The leveling method is not restricted to a certain sensor technology. To detect the screed and pulling point positions, in particular measurement systems, such as e.g., tachymeters and/or laser receivers, can be employed. An inclination sensor which measures the set angle of the screed would also be conceivable. One of the two ultrasonic sensors could be replaced by such an inclination sensor. The distance measured by the replaced sensor could then be determined by trigonometric relations. Thereby, one can also deviate from the defined sensor positions at the pulling point and the screed's trailing edge which can result in advantages in practice. The use of measuring systems without any fixed reference, for example, a "BigSki"™ mounted to the tow bar 5 of the road finishing machine 1 which measures the distance on the subsoil 3 at various positions, would possibly also be usable with losses of precision.

In the leveling system 10A, the subsoil profile $z_u$ is not known. $z_u$ acts, via the running gear fw, on the pulling point 6 and thus forms the unknown pulling point disturbance $d_{zp}=fw(z_u)$. In particular to compensate this unknown pulling point disturbance $d_{zp}=fw(z_u)$, the central control loop 12 of the cascade control 100A which adjusts the pulling point position $z_{zp}$ is employed.

Figure 4:
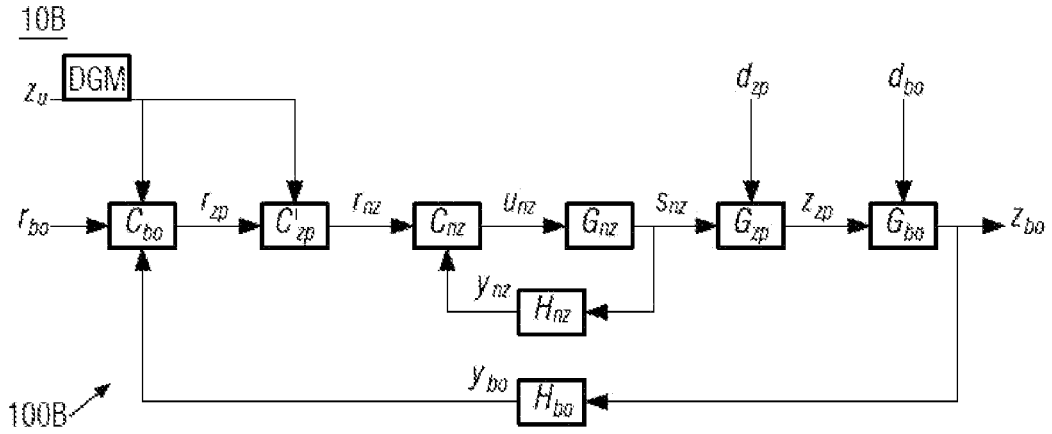
FIG. 4 shows a schematic representation of a second variant of the leveling system for the screed of the road finishing machine according to the disclosure.

However, if according to FIG. 4, a sufficiently precise digital terrain model (DGM) is given, $z_u$ is given by this model and $d_{zp}$ can be calculated by means of the running gear fw of the road finishing machine 1. Thus, the pulling point 6 is influenced by a known disturbance in the present case. The consequence is that the central control loop 12 including the sensor $H_{zp}$ is no longer required and could be replaced by a pulling point control $C'_{zp}$. Moreover, the information with respect to $z_u$ can be used for an optional disturbance variable feedforwarding. The measuring means $H_{dbo}$ and $H_{dzp}$ can consequently also be omitted.

FIG. 4 shows the embodiment which comprises a leveling system 10B with a cascade control 100B which processes a digital terrain model (DGM). The screed control unit $C_{bo}$ is nearly unchanged compared to the basic design according to FIG. 3. A difference to the shown variant of FIG. 3 is that, if a disturbance variable feedforwarding is used, the disturbance $d_{bo}$ in the screed control unit $C_{bo}$ is calculated from $z_u$. In contrast to the basic design according to FIG. 3, the pulling point control unit $C_{zp}$ in FIG. 4 is no longer present but is calculated by the pulling point control $C'_{zp}$ which calculates, from the known subsoil profile $z_u$ and the desired position of the pulling point $r_{zp}$, a desired value position $r_{nz}$ of the leveling cylinder. This calculation is based on equations (2) and (3). First of all, the actual values $y_{zp}$ and $y_{nz}$ are replaced by the corresponding desired values $r_{zp}$ and $r_{nz}$. Subsequently, equation (3) is resolved with respect to $d_{zp}$. $d_{zp}=fw(z_u)$ applies. The insertion of $y_{zp}=r_{zp}$, $y_{nz}=r_{nz}$ and $d_{zp}=fw(z_u)$ in equation (2) and a resolution with respect to $r_{nz}$ leads to $$r_{nz}=fw(z_u)-r_{zp}-z_{ref}+s_{zp0} \tag{7}$$

whereby the control algorithm for the pulling point control $C'_{zp}$ is given.

It is noted that the leveling system 10A, cascade control 100A, inner control loop 11, central control loop 12, outer control loop 13, and/or any other system, control, control loop, unit, control unit, controller, machine, screed, sensor, device, module, model, arrangement, feature, function, functionality, step, algorithm, operation, or the like described herein may comprise and/or be implemented in or by one or more appropriately programmed processors (e.g., one or more microprocessors including central processing units (CPU)) and associated memory and/or storage, which may include data, firmware, operating system software, application software and/or any other suitable program, code or instructions executable by the processor(s) for controlling operation thereof and/or for performing the particular algorithms represented by the various functions and/or operations described herein, including interaction between and/or cooperation with each other. One or more of such processors, as well as other circuitry and/or hardware, may be included in a single ASIC (Application-Specific Integrated Circuitry) or individually packaged or assembled into a SoC (System-on-a-Chip). As well, several processors and various circuitry and/or hardware may be distributed among several separate components and/or locations, such as a road finishing machine, a screed, a mobile unit or mobile computing device, or a remote server.

What is claimed is:

1. A road finishing machine comprising:

a screed for producing a paving layer on a subsoil on which the road finishing machine is operable to move in a laying direction during a pavement drive; and a leveling system for height adjustment of the screed for compensating for irregularities in the subsoil, wherein the leveling system includes a cascade control comprising an outer control loop which includes a first control unit configured to determine, on the basis of a detected actual value of a screed height of the screed relative to a predetermined reference, and on the basis of a desired value of the screed height relative to the predetermined reference, a desired value of a pulling point position of a pulling point of the screed relative to the predetermined reference, and an inner control loop which includes a second control unit configured to determine, on the basis of a detected actual value of a leveling cylinder position of an extendable piston of a leveling cylinder attached to the pulling point, and on the basis of a desired value of the leveling cylinder position, a control signal for the leveling cylinder by which the leveling cylinder can be controlled;

wherein the cascade control further comprises a central control loop between the outer and the inner control loops that includes a third control unit configured to determine, on the basis of a detected actual value of the pulling point position of the pulling point of the screed relative to the predetermined reference, and on the basis of the desired value of the pulling point position determined by the first control unit, the desired value of the leveling cylinder position for the second control unit, or a pulling point control between the outer and the inner control loops, the pulling point control configured to determine, on the basis of the desired value of the pulling point position of the pulling point of the screed determined by the first control unit, the desired value of the leveling cylinder position for the second control unit;

wherein the leveling system for the outer control loop includes at least one first sensor configured to detect the actual value of the screed height and wherein the at least one first sensor is a distance sensor for detecting a distance to the predetermined reference which is positioned in a region of a screed's trailing edge of the screed.

2. The road finishing machine according to claim 1, wherein the outer control loop comprises a closed-loop controlled system whose output quantity is the detected actual value of the screed height of the screed relative to the predetermined reference, and/or whose input quantity is the detected actual value of the pulling point position of the pulling point of the screed relative to the predetermined reference.

3. The road finishing machine according to claim 1, wherein the inner control loop comprises a closed-loop controlled system whose output quantity is the detected actual value of the leveling cylinder position of the extendable piston of the leveling cylinder attached to the pulling point, and/or whose input quantity is the control signal for the leveling cylinder.

4. The road finishing machine according to claim 1, wherein the leveling system for the inner control loop includes at least one second sensor configured to detect the actual value of the leveling cylinder position.

5. The road finishing machine according to claim 4, wherein the second sensor is a distance sensor positioned in the region of the leveling cylinder for detecting the leveling cylinder position of the piston of the leveling cylinder.

6. The road finishing machine according to claim 1, wherein the central control loop comprises a closed-loop controlled system whose output quantity is the detected actual value of the pulling point position of the screed, and/or whose input quantity is the detected actual value of the leveling cylinder position.

7. The road finishing machine according to claim 1, wherein the leveling system for the central control loop includes a third sensor configured to detect the actual value of the pulling point position to the predetermined reference.

8. The road finishing machine according to claim 7, wherein the third sensor is a distance sensor for detecting a distance to the predetermined reference which is positioned in the region of the pulling point of the screed.

9. The road finishing machine according to claim 1, wherein the cascade control includes at least one disturbance variable feedforwarding.

10. The road finishing machine according to claim 1, wherein the cascade control is supplemented by a layer thickness calculation module configured to determine, on the basis of an identified current layer thickness of the produced paving layer, and/or on the basis of a desired value of the layer thickness of the paving layer to be produced, the desired value of the screed height for the outer control loop.

11. The road finishing machine according to claim 10, wherein the layer thickness calculation module is configured to determine the layer thickness from a progression of the sensor measurements employed for leveling.

12. A method of leveling a screed of a road finishing machine for producing a paving layer on a subsoil on which the road finishing machine is moving in a laying direction during a pavement drive, wherein irregularities in the subsoil are compensated by a leveling system which performs a leveling of the screed by a cascade control, wherein an outer control loop of the cascade control determines, by a first control unit, on the basis of a detected actual value of a screed height of the screed relative to a predetermined reference, and on the basis of a desired value of the screed height relative to the predetermined reference, a desired value of a pulling point position of a pulling point of the screed relative to the predetermined reference, and wherein an inner control loop of the cascade control determines, by a second control unit, on the basis of a detected actual value of a leveling cylinder position of an extendable piston of a leveling cylinder attached to the pulling point of the screed, and on the basis of a desired value of the leveling cylinder position, a control signal for the leveling cylinder by which the leveling cylinder is controlled for height adjustment of the screed, the method comprising:

determining, by a third control unit of a central control loop present between the outer and the inner control loops of the cascade control, on the basis of a detected actual value of the pulling point position of the pulling point of the screed relative to the predetermined reference, and on the basis of the desired value of the pulling point position determined by the first control unit, the desired value of the leveling cylinder position for the second control unit; or determining, by a pulling point control present between the outer and the inner control loops of the cascade control, on the basis of the desired value of the pulling point position of the pulling point of the screed determined by the first control unit, the desired value of the leveling cylinder position for the second control unit;

wherein the leveling system for the outer control loop includes at least one first sensor configured to detect the actual value of the screed height and wherein the at least one first sensor is a distance sensor for detecting a distance to the predetermined reference which is positioned in a region of a screed's trailing edge of the screed.

13. The method according to claim 12, wherein the cascade control is supplemented by at least one disturbance variable feedforwarding and/or by a layer thickness calculation module which determines, on the basis of an identified layer thickness of the produced paving layer, and/or on the basis of a desired value of a layer thickness of the paving layer to be produced, the desired value of the screed height for the outer control loop.

14. The method according to claim 12, wherein determining the desired value of the leveling cylinder position for the second control unit by the pulling point control is further on the basis of a digital terrain model of the subsoil on which the road finishing machine is moving for producing the paving layer.

15. The road finishing machine according to claim 1, wherein the pulling point control is further configured to determine the desired value of the leveling cylinder position for the second control unit on the basis of a digital terrain model of the subsoil on which the road finishing machine is moving for producing the paving layer.

16. A leveling system for height adjustment of a screed of a road finishing machine, the screed for producing a paving layer on a subsoil on which the road finishing machine is operable to move in a laying direction during a pavement drive, the leveling system for compensating for irregularities in the subsoil and including a cascade control, the leveling system comprising:

an outer control loop which includes a first control unit configured to determine, based on a detected actual value of a screed height of the screed relative to a predetermined reference, and based on a desired value of the screed height relative to the predetermined reference, a desired value of a pulling point position of a pulling point of the screed relative to the predetermined reference, and an inner control loop which includes a second control unit configured to determine, based on a detected actual value of a leveling cylinder position of an extendable piston of a leveling cylinder attached to the pulling point, and based on a desired value of the leveling cylinder position, a control signal for the leveling cylinder which the leveling cylinder can be controlled;

wherein the leveling system further comprises a central control loop between the outer and the inner control loops that includes a third control unit configured to determine, based on a detected actual value of the pulling point position of the pulling point of the screed to the predetermined reference, and based on the desired value of the pulling point position determined by the first control unit, the desired value of the leveling cylinder position for the second control unit, or a pulling point control between the outer and the inner control loop, the pulling point control configured to determine, based on the desired value of the pulling point position of the pulling point of the screed determined by the first control unit, the desired value of the leveling cylinder position for the second control unit;

wherein the leveling system includes at least one first sensor for the outer control loop which is embodied to detect the actual value of the screed height, wherein the at least one first sensor is embodied to detect a distance of a screed's trailing edge of the screed to the predetermined reference.

17. The leveling system according to claim 16, wherein the cascade control includes at least one disturbance variable feedforwarding.

18. The leveling system according to claim 16, wherein the pulling point control is further configured to determine the desired value of the leveling cylinder position for the second control unit based on a digital terrain model of the subsoil on which the road finishing machine is moving for producing the paving layer.

* * * * *